US011278163B1

(12) United States Patent
Cowan

(10) Patent No.: US 11,278,163 B1
(45) Date of Patent: Mar. 22, 2022

(54) STRETCHABLE BATHING TOWEL

(71) Applicant: Delroy Cowan, Miramar, FL (US)

(72) Inventor: Delroy Cowan, Miramar, FL (US)

( * ) Notice: Subject to any disclaimer, the term of this patent is extended or adjusted under 35 U.S.C. 154(b) by 0 days.

(21) Appl. No.: 17/466,700

(22) Filed: Sep. 3, 2021

(51) Int. Cl.
*A47K 7/02* (2006.01)
*A47K 10/02* (2006.01)

(52) U.S. Cl.
CPC ..... *A47K 10/02* (2013.01); *A47K 7/02* (2013.01); *A47K 7/022* (2013.01)

(58) Field of Classification Search
CPC ..... A47K 7/02; A47K 7/022
See application file for complete search history.

(56) References Cited

U.S. PATENT DOCUMENTS 1,379,925 A * 5/1921 Kawasaki ..... A47K 7/022 15/222
1,473,315 A * 11/1923 Poirier ..... A47K 7/022 15/222
1,699,261 A * 1/1929 Wissmar ..... A47K 7/02 15/222
2,093,110 A * 9/1937 Meleady ..... A46B 5/06 15/222
2,318,680 A * 5/1943 Ellinger ..... A47K 7/022 15/222
3,099,032 A * 7/1963 Webb ..... A47K 7/022 401/8
3,130,441 A * 4/1964 Hahn ..... A47K 7/022 401/201
3,959,841 A * 6/1976 Horne ..... A47K 7/022 15/104.94
6,012,195 A * 1/2000 Lindsay ..... A47K 7/022 15/104.94
6,026,531 A * 2/2000 Pruitt ..... A47K 7/022 15/160
7,410,318 B2 * 8/2008 Chambers ..... A45D 34/04 15/104.94
D627,106 S * 11/2010 Comin ..... D28/91.2
9,339,152 B1 * 5/2016 Gallimore ..... A47K 7/022
2003/0041401 A1 * 3/2003 Chen ..... A47K 7/028 15/110

* cited by examiner

*Primary Examiner* — Michael D Jennings
(74) *Attorney, Agent, or Firm* — Christopher J. Vandam, PA; Chris Van Dam

(57) ABSTRACT

A bathing towel with a low stretch and absorbent layer affixed to a central segment of a material that stretches several hundred percent axially. Each end of the stretchable layer has a loop to be used as a handle. By affixing the absorbent layer to the central section of the stretchable layer, the central section of the stretchable layer will not stretch and tends to remain flat during use washing the body.

4 Claims, 4 Drawing Sheets

STRETCHABLE BATHING TOWEL

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to personal bathing, and more particularly, to an improved towel that has structural and nonstructural sections to more easily bathe difficult locations on the body.

2. Description of Related Art Including Information Disclosed Under 37 CFR 1.97 and 37 CFR 1.98

Several designs for towels have been designed in the past. None of them, however, include a structural panel with loops at both ends with a substantially non-stretchable central section with enhanced absorbency.

Applicant believes that the closest prior art references correspond to commonly available hand towels. Users grab an end of the towel to pull back and forth over their back. However, these differ from the present invention because the present invention provides stretchable hand loops on either end of the towel that allows easier grasping and also provides an absorbent central section, where the scrubbing mainly occurs.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide a stretchable towel that is easy to grasp and carries significant soap and a lather for improved cleaning while bathing.

Another object of the present invention is to provide a device that is easy to use and lays flat on the back while scrubbing.

Still another object of the present invention is to provide a device that enhances a bathers ability to apply soap and scrub difficult to reach places on the body.

Another object of the present invention is to provide a bathing device that is easier to use for those with limited mobility, such as, the elderly or injured people.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
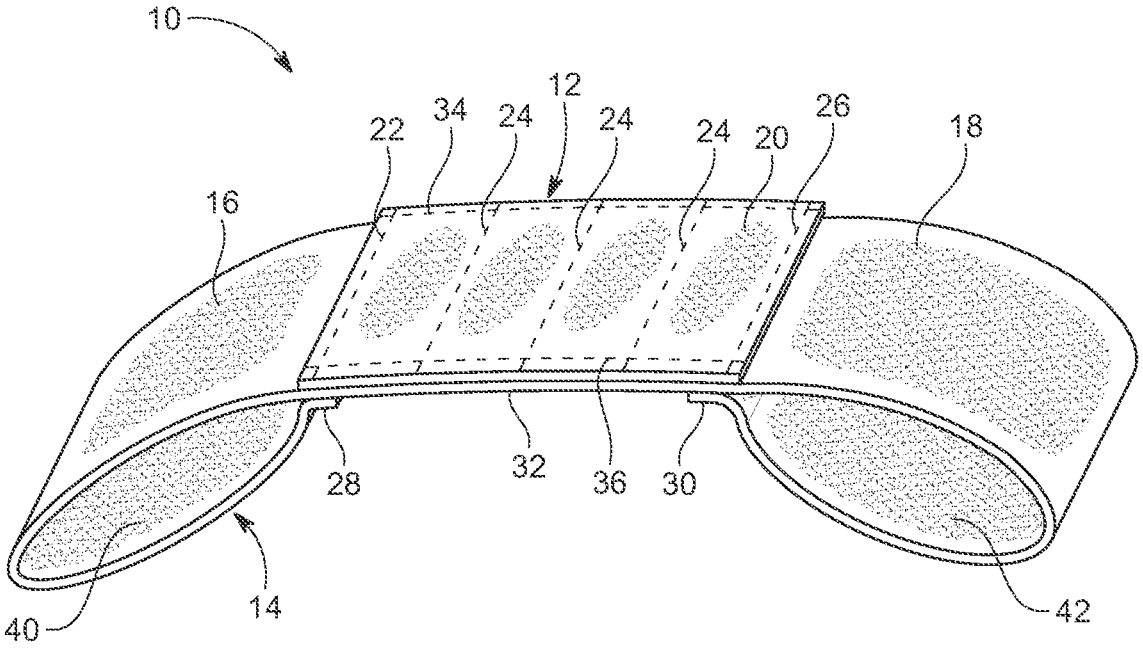
FIG. 1 shows a perspective view of a version of the stretchable bathing towel.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the stretchable towel, the towel, the bathing towel, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the context situation.

Figure 3:
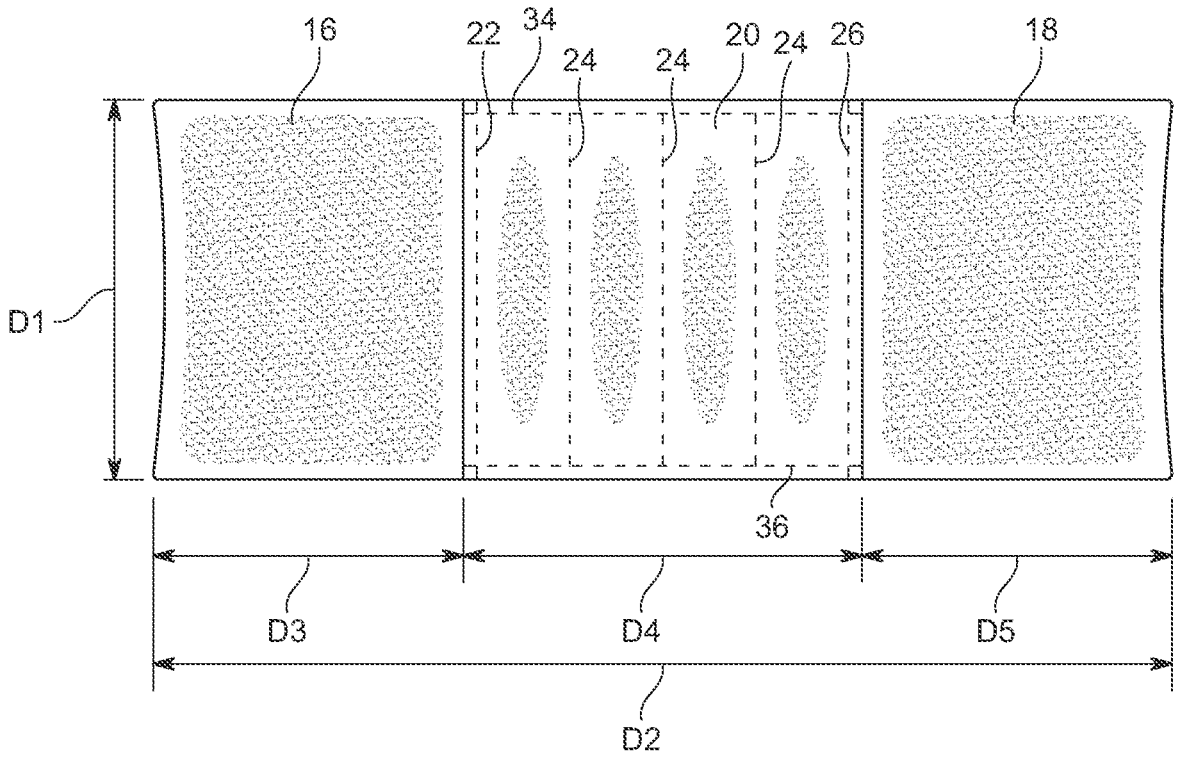
FIG. 3 is a plan view of a pad side of the stretchable bathing towel.
Figure 4:
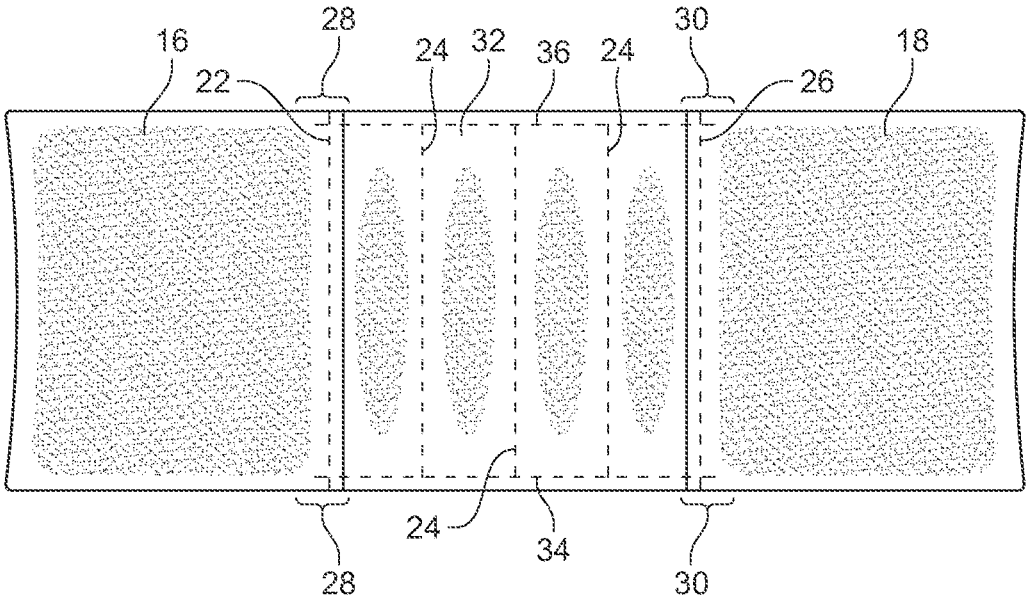
FIG. 4 is a plan view of the opposite side of the stretchable bathing towel shown in FIG. 3.

Referring now to the drawings, where the present invention is generally referred to with numeral 10, it can be observed that it basically includes a pad assembly 12, a handle assembly 14, a loop 16, a loop 18, a pad 20, an edge seam 22, a medial seam 24, an edge seam 26, an edge 28, an edge 30, a medial section 32, a seam 34, a seam 36, a back 38, an opening 40 and an opening 42. Dimensional components D1 through D5 are also shown in FIG. 3 to demonstrate an effective configuration of the stretchable bathing towel.

Figure 2:
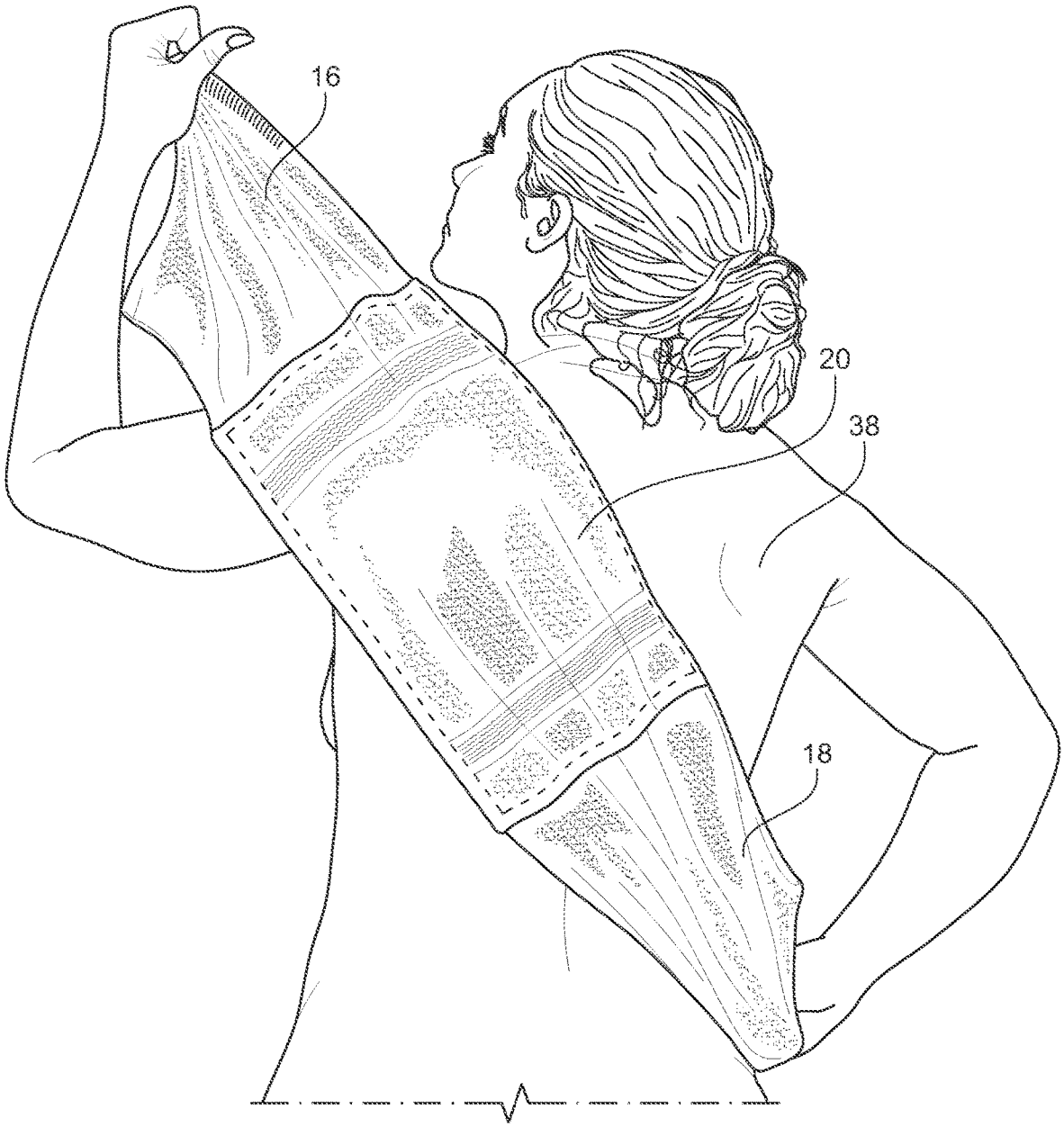
FIG. 2 shows a perspective view of the stretchable towel in use while bathing.

Generally, the device is comprised of a handle assembly 14 on each side of a medial section 32. Looking at FIG. 1, the handle assembly 14 is on the left and is comprised of a loop 16 having an opening 40. Similarly, the loop 18, on the right, includes an opening 42. Openings 40 and 42 are dimensioned to engage a hand of the user, as shown in FIG. 2.

The stretchable towel is constructed of two primary elements: a pad assembly 12 and a handle assembly 14. The handle assembly 14 includes both loops 16 and 18 and medial section 32. In one embodiment of the stretchable towel's handle assembly 14, the loop 16, loop 18 and medial section 32 are fabricated from a single piece of stretchable material. The pad assembly 12 is fabricated from another panel of material that is substantially not stretchable.

The central pad assembly 12 is preferably fabricated from an absorbent material. For example, terry cloth, felt, woven fiber, non-woven fiber, synthetic sponge or other material that is able to absorb water and associated lather while retaining a minimal stretch characteristic. It should be appreciated that most of these types of fabrics will have a small degree of stretch. However, the stretch in either direction is generally limited to less than ten percent in any direction.

During fabrication, the pad assembly 12 is laid over a medial section 32 of the handle assembly 14. The opening 40 is formed by doubling back the loop 16 section so that the edge 28 of the handle assembly 14 is substantially parallel to the edge of the pad assembly 12. The edge seam 22 is sewn through the edge of the pad assembly 12 and through both layers of the loop 16 at edge 28.

Similarly, the opening 42 is formed by doubling back the loop 18 section so that the edge 30 of the handle assembly 14 is substantially parallel to the respective edge of the pad assembly 12. The edge seam 26 is sewn through the edge of the pad assembly 12 and through both layers of the loop 18 at edge 30.

Additional stitching is provided to further attach the pad assembly 12 to the medial section 32 of the handle assembly 14. Seam 36 and opposing seam 34 attach the pad 20 to the medial section 32. Additional medial seams 24 are provided to connect to the pad 20 to the medial section 32 that are oriented transverse to the long axis of the pad 20.

By a connecting the pad assembly 12 to the medial section 32 of the handle assembly 14, the medial section 32 is prevented from substantial stretching in either medial or longitudinal axes. The edge seam 22, edge seam 26, seam 28, seam 34, seam 36 and medial seams 24 fuse the pad 20 to the medial section 32. Because the pad 20 does not substantially stretch, therefore the medial section 32 of the handle assembly 14 is prevented from substantial stretch. An adhesive, thermal bonding or other attachment means may be equally effective to connect the pad 20 to the medial section 32.

The handle assembly 14 is selected from a material that allows substantial axial stretching. Through extensive experimentation and testing it has been discovered that an axial stretch ratio of between one hundred and four hundred percent is effective. A stretch factor of approximately three hundred percent of the axial length may be preferred by some users. The material of the handle assembly 14 may also be provided with a limited stretch along the transverse dimension.

In one effective configuration of the device, the handle assembly 14 is constructed from a material comprising approximately sixty-one percent polyester fibers and thirty-nine percent nylon fibers. Other stretchable fabrics may also be effective that result in axial stretch and performance factors of about one hundred to four hundred percent from an unstretched state. Other elastane or polyether-polyurea copolymer blended fabrics may also effectively be substituted.

FIG. 2 shows an example of the stretchable towel as may be typically used. A user of the device first wets the pad 20 with water and applies a soap or body wash of their selection. Then they grasp loop 16 with one hand and loop 18 with the other hand and pull the stretchable towel over their back with the pad 20, now impregnated with soapy water, against the back 38 of the user. Loop 16 and loop 18 are then alternately pulled to rub the pad 20 against the user's back 38.

It should be appreciated that FIG. 2 shows the pad 20 oriented away from the back 38 of the user. While this orientation may also be functional, flipping of the device so that the pad 20 is in direct contact with the back 38 of the user may be more effective. The depiction in FIG. 2 is provided to emphasize that the pad 20 is in the central section of the handle assembly 14.

An important performance advantage of the configuration of the stretchable towel is that the pad 20 remains substantially flat during normal use. By remaining flat, as shown in FIG. 2, the pad 20 is able to maintain contact with the back 38 of the user throughout the entire area of the pad 20 this allows for a greater surface area of contact to enhance cleaning performance.

Further by having the pad 20 remain substantially flat, the pad does not wring out water and lather as may occur if the pad 20 were permitted to stretch, twist and wrinkle. Since the loop 16 and loop 28 are generally not in contact with the back 38 of the user, the absorbency of the handle assembly 14 material is not critical to the functionality of the design.

Generally, the dimension of the loop 16 and 18 are adapted so that the hands of a user may easily grasp the respective loops as a handle to avoid losing one's grip. The length of the device from end and is also adapted so that the user is able to comfortably grasp both ends while rubbing the device on their back 38, as shown in FIG. 2.

The absolute dimensions of the device are not critical to the inventive concept. However, extensive testing and experimentation have suggested approximate dimensions that make the device effective for a majority of users. The example in FIG. 3 shows particular dimensions to consider for adapting incising the device for specific applications and sizes of user.

Typically, an effective size of the transverse axis, identified by dimension D1 in FIG. 3 is about eight inches, but may be between about four and twelve inches. The overall unstretched longitudinal axis, represented by dimension D2 may be about twenty inches, but could be between about twelve and thirty inches. The width of the unstretched loop segments 16 and 18, represented by dimension D3 and D5 respectively is approximately four inches, but could be anywhere between about three and eight inches. The axial dimension of the pad assembly 12, represented by dimension D4, may be approximately twelve inches, but could be anywhere between about six and eighteen inches.

Because the pad 20 is affixed to the medial section 32, this central segment of the structural towel does not significantly stretch during use. As noted above, the pad 20 may stretch about ten percent axially. The loops 16 and 18 are intended to stretch axially approximately three hundred percent and therefore each respective loop 16 and 18 may have the axial dimensions respectively D3 and D5 extend to approximately twelve inches each before limiting the stretch and avoiding failure of the device.

An important version of the invention can be fairly described of a bathing towel comprised of a handle assembly and a pad assembly. A hand assembly terminates with a first loop for a handle on a first and and terminates with a second loop on a second and for a second handle. The pad assembly is affixed to the medial section of the handle assembly. The pad may be sewn into the medial section of the handle assembly and acts to both prevent axial stretching of the handle assembly and as a component to hold water and soap. The pad assembly does not stretch actually greater than about ten percent relative to the unstretched axial dimension of the pet assembly. The first loop and second loop each stretched between one hundred and four hundred percent relative to an unstretched axial dimension. The pad assembly is configured of an absorbent material, similar to a bath towel allowing it to absorb water and soap. The pad assembly is more absorbent than the handle assembly because the handle assembly need not hold soap or water because it is not used as a scrubbing surface. Optionally, the dimensions of the device may be such that it is approximately between foreign twelve inches wide, the pad assembly is between six and eighteen inches long and each of the unstretched loops are between about three and eight inches in an axial direction. Optionally, the pad assembly is constructed of a terry cloth material or other woven or nonwoven fabric or other material disclosed infra that is generally low stretch and can hold water and soap. Optionally, the handle assembly is constructed of a material containing a blend of at least two selected from the group of polyester, nylon, elastane and polyether-polyurea copolymer.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A bathing towel comprised of a handle assembly (14) and a pad assembly (12);

the handle assembly (14) is comprised of a medial section (32) between a first loop (16) on a first end and a second loop (18) on a second end;

the pad assembly (12) overlays the entirety of the medial section (32);

a periphery of the pad assembly (12) is fused by at least one edge seam of the handle assembly to a periphery of the medial section (32) of the handle assembly (14);

the pad assembly (12) does not stretch axially greater than ten percent along an unstretched axial dimension (D4);

the first loop (16) and second loop (18) each stretch between one hundred and four hundred percent along an unstretched, respective axial dimensions (D3 and D5);

the pad assembly (12) is configured of a material with a greater absorbency than the handle assembly (14).

2. The bathing towel of claim 1 further characterized in that a transverse dimension (D1) of the entire bathing towel is between four and twelve inches; and the axial dimension (D4) of the pad assembly (12) is between six and eighteen inches; and the unstretched axial dimensions (D3 and D4) respectively of the first loop (16) and second loop (18) are each between three and eight inches.

3. The bathing towel of claim 1 further characterized in that the pad assembly (12) is constructed of a terry cloth material.

4. The bathing towel of claim 1 further characterized in that the handle assembly (14) is constructed of a material containing a blend of at least two selected from polyester, nylon, elastane and polyether-polyurea copolymer.

* * * * *